United States Patent [19]

Tsubuko et al.

[11] Patent Number: 4,855,207

[45] Date of Patent: Aug. 8, 1989

[54] DEVELOPER FOR ELECTROPHOTOGRAPHY

[75] Inventors: Kazuo Tsubuko; Kayoko Nagai, both of Numazu, Japan

[73] Assignee: Ricoh Company, Ltd., Tokyo, Japan

[21] Appl. No.: 166,881

[22] Filed: Mar. 11, 1988

[30] Foreign Application Priority Data

Mar. 13, 1987 [JP] Japan ..... 62-058203

[51] Int. Cl.[4] ..... G03G 9/10; G03G 9/12

[52] U.S. Cl. ..... 430/109; 430/111; 430/114

[58] Field of Search ..... 430/109, 111, 114

[56] References Cited

U.S. PATENT DOCUMENTS

| | | | |
|---|---|---|---|
| 3,941,898 | 3/1976 | Sadamastu | 430/110 |
| 3,980,576 | 9/1976 | Vijayendran | 430/109 |
| 4,565,763 | 1/1986 | Vehiyama | 430/109 |
| 4,595,646 | 6/1986 | Tsubuko | 430/115 |
| 4,690,881 | 9/1987 | Nagai | 430/114 |
| 4,780,389 | 10/1988 | El-Sayed . | |

FOREIGN PATENT DOCUMENTS

| | | | |
|---|---|---|---|
| 50-99330 | 8/1975 | Japan | 430/114 |
| 53-69635 | 6/1978 | Japan | 430/114 |
| 54-2740 | 1/1979 | Japan | 430/109 |
| 55-35321 | 3/1980 | Japan | 430/114 |
| 56-38057 | 4/1981 | Japan | 430/114 |
| 58-37653 | 3/1983 | Japan | 430/109 |
| 59-160153 | 9/1984 | Japan | 430/114 |
| 60-15645 | 1/1985 | Japan | 430/109 |
| 2017949A | 10/1979 | United Kingdom | 430/109 |

*Primary Examiner*—Paul R. Michl
*Assistant Examiner*—Jeffrey A. Lindeman
*Attorney, Agent, or Firm*—Flynn, Thiel, Boutell & Tanis

[57] ABSTRACT

A developer for electrophotography is disclosed, which comprises toner particles containing therein at least an olefin resin having a melt index of 25~700 g/10 min, which toner particles may comprise a colorant which is prepared by a flushing method by using a pigment component and an olefin resin having a melt index of 25~700 g/10 min, when necessary, with addition thereto a humic acid component selected from the group consisting of humic acid, a salt of humic acid, and a humic acid derivative.

11 Claims, No Drawings

DEVELOPER FOR ELECTROPHOTOGRAPHY

BACKGROUND OF THE INVENTION

The present invention relates to a dry-type developer and a wet-type developer for use in electrophotography, which are capable of yielding improved image density, resolution, and image fixing property, without a strike-through phenomenon that developed images on a copy are visible from the back side of the copy sheet (hereinafter this phenomenon is referred to as the strike-through phenomenon).

As a developer for use in electrophotography, a toner comprising polyethylene wax as a binder agent and an organic or inorganic pigment, such as carbon black and phthalocyanine blue, which is dispersed in the binder agent, is conventionally known. The toner particles of such a toner containing polyethylene wax have the advantage over other toner particles that higher image density can be obtained. However, the toner particles have the shortcoming that the images are depressed and defaced in the course of the image transfer process in a copying machine, which degrades the image quality, in particular, image resolution.

A trial has been carried out to prevent the decrease of the sharpness of image and resolution by using an oxidized polyethylene wax instead of polyethylene wax as proposed in Japanese laid-open patent application No. 54-97157. However, when oxidized polyethylene wax is employed, there is a problem that high image density cannot be increased any further.

In a wet-type toner, low-molecular weight polyolefins are in general use. However, the melting viscosity of such low-molecular weight polyolefins is so low that a colorant such as an organic pigment and carbon black cannot be well dispersed therein when kneaded in a kneader. Therefore high image density cannot be obtained when such low-molecular weight polyolefins are employed in the toner.

Furthermore, the melt index of the low-molecular weight polyolefins is so high that the image areas developed by a toner containing such a polyolefin are fused and tend to flow like a melted candle when heated along the fibers of a copy sheet, when heated in the course of the image fixing process. The result is that the previously mentioned strike-through phenomenon so as to be totally unsuitable for duplex copying, poor image resolution and poor image fixing to such an extent that developed images can be readily erased by an eraser, and the adhesion of the fused developer to an image fixing roller are caused.

In addition to the above-mentioned polyethylene wax, oxidized polyethylene wax and low-molecular weight polyolefins, polystyrene resin, acrylic resin, epoxy resin, polyester resin, and rubber are employed as binder agents for the conventional toners. However these resins also have the same or similar shortcomings as mentioned above more or less.

SUMMARY OF THE INVENTION

It is therefore an object of the present invention to provide a developer for electrophotography from which the conventional shortcomings have been eliminated, and which is capable of yielding high quality images.

Another object of the present invention is to provide a developer (toner) which can be used in both a dry-type electrophotographic development and a wet-type electrophotographic development.

The above objects of the present invention can be achieved by a developer in which toner particles thereof contain at least an olefin resin having a melt index of 25~700 g/10 min. This melt index is the value obtained when measured under a load of 2160±10 g at 190±0.4° C.

DETAILED DESCRIPTION OF THE PREFERRED EMBODIMENTS

Olefin resins having a melt index of 25 to 700 g/10 min for use in the present invention are (i) olefin resins comprised of a polyolefin main backbone chain to which polar groups, such as carboxyl group, hydroxyl group, glycidyl group, and amino group are joined, and (ii) olefin resins partially having a bridge structure formed by a cross-linking agent or a radical initiator.

The olefin resins having a melt index of 25 to 700 g/10 min can be advantageously obtained, for example, by copolymerizing a polyolefin with a monomer having a polar group, or by adding a cross-linkable monomer to a polyolefin to form a polymer having a bridge structure, or by using the two methods in combination.

Since the olefin resins having a melt index of 25 to 700 g/10 min have the above-mentioned structure, when the resins are used together with a pigment to form toner particles, the toner particles have excellent dispersibility and do not suddenly exhibit thermoplasticity in a state where the toner particles are dispersed in a solvent or carrier liquid, or upon the toner particles used as dry-type toner particles or wet-type toner particles entering an image fixing process. Therefore, the toner particles containing the olefin resin hardly adhere to an image fixing roller even when fused in the image fixing process. Furthermore, the fixing performance of the toner particles increases as the fused toner particles are cooled and become hard, because of the high molecular weight of the olefin resin contained in the toner particles.

Moreover, since the surface of the toner particles is covered with the polymer having the above-mentioned polar groups, the toner particles are excellent in the development performance and image transfer performance. Therefore high image density and improved image resolution can be obtained by the toner particles.

When the melt index is less than 25 g/10 min, the fluidity of the toner particles when heated is too small to obtain necessary image fixing performance, while when the melt index is more than 700 g/10 min, the fluidity of the toner particles when heated is too great to obtain sharp images, and the toner particles readily adhere to a heated image fixing roller, so that the objects of the present invention cannot be achieved.

The developer according to the present invention may be either a liquid developer or a dry-type developer. In the case where the developer is a dry-type developer, it may be either a one-component type developer or a two-component type developer.

A liquid developer (or toner) according to the present invention can be prepared by dispersing 1 part by weight of a pigment and 0.1 to 20 parts by weight of the olefin resin having a melt index of 25 to 700, more preferably 1 to 10 parts by weight of the olefin resin, in 10 to 100 parts by weight of a dispersing medium (preferably the same dispersing medium as a carrier liquid of the developer) in a dispersion mixer, such as ball mill, Keddy mill, and attritor, to form a concentrate liquid developer, and then diluting the concentrate liquid developer with the carrier liquid.

When necessary, a thermoplastic resin and a charge controlling agent may be added to the above liquid developer in the course of the production thereof.

A dry-type developer (or toner) according to the present invention can be prepared by kneading a mixture of 1 part by weight of a colorant and 0.1 to 20 parts by weight of the olefin resin having a melt index of 25 to 700 g/10 min by a heat roller, cooling the kneaded mixture, grinding the mixture to finely-divided particles and classifying the particles.

When necessary, a styrene-acryl copolymer, rosin-modified resin, silicon oxide, and a charge controlling agent may be added to the above dry-type developer (or toner).

The inventors of the present invention have confirmed that a better developer can be obtained by further addition of humic acid, salts of humic acid and/or humic acid derivatives (hereinafter collectively referred to as the humic acid component) to the components of the developer according to the present invention. This advantage is considered to be obtained because when the humic acid component is added to the components of the developer together with the olefin resin having a melt index of 25 to 700 g/10 min, not only the dispersibility of the pigment contained in the developer (both the wet-type developer and dry-type developer), but also the dispersibility of the developer itself is improved because of the excellent compatibility of the humic acid component with other resin components and the high melting viscosity thereof. Thus, the blending of the developer with other resins can also be facilitated.

Another advantage obtained by use of the humic acid component in combination with the olefin resin is more apparent when the developer according to the present invention is compared with a conventional liquid developer which is prepared by kneading a resin other than the above-mentioned olefin resin and an inorganic or organic pigment such as carbon black and phthalocyanine blue, grinding the kneaded mixture to prepare a colorant, which is used as toner particles, and then uniformly dispersing the toner particles in a high electric insulating carrier liquid having a low dielectric constant.

In such a conventional colorant, the primary particles of the organic or inorganic pigment particles aggregate so strongly that they cannot be easily dispersed to the extent that those particles turn out to be of the primary particle size even if they are dispersed in a vehicle in a ball mill, in an attritor or in a heat roll mill.

The olefin resins having a melt index of 25 to 700 g/10 min are, as mentioned previously, for example, ethylene-vinyl acetate-aryl copolymer, ethylene-acryl copolymer and cross-linked copolymers thereof, and have the features that the melting viscosity thereof when heated is high, the solubility in organic solvents is high, and the adhesiveness thereof is also high due to the excellent compatibility with other resins. Furthermore, pigments are dispersed so well in the olefin resins that colorants having high density can be obtained.

Specific examples of the olefin resins having a melt index of 25~700 g/10 min are:

(1) Ethylene-vinyl acetate-lauryl methacrylate copolymer resin (mole ratio 60:30:10)
(2) Ethylene-vinyl acetate-methyl methacrylate-dimethylamino ethyl methacrylate copolymer resin (mole ratio 50:30:10:10)
(3) Ethylene-vinyl acetate-ethyl acrylate-divinyl benzene copolymer resin (mole ratio 50:20:20:10)
(4) Ethylene-vinyl acetate-methacrylic acid copolymer resin (mole ratio 50:40:10)
(5) Propylene-vinyl acetate-lauryl methacrylate copolymer resin (mole ratio 60:30:10)
(6) Propylene-vinyl acetate-acrylic acid copolymer resin (mole ratio 60:9:31)
(7) Ethylene-ethyl acrylate copolymer resin (mole ratio 50:50).
(8) Ethylene-butyl acrylate-acrylic acid copolymer resin (mole ratio 60:30:10)
(9) Propylene-lauryl methacrylate-methacrylic acid copolymer resin (mole ratio 70:20:10)
(10) Ethylene-acrylic acid-trimethylolpropane triacrylate copolymer resin (mole ratio 80:15:5)
(11) Propylene-ethyl laurate copolymer resin (mole ratio 50:50).

Examples of commercially available olefin resins with a melt index of 25~700 g/10 min are EVAFLEX A-701, A-702, A-703, A-704, A-705, A-706, A-707, A-708, A-709, A-710, N-410, N-035, N-010, N-0903, N-549, N-1214, N-1525, N-925 (made by Du Pont Mitsui Polychemical Co., Ltd.)

Examples of carbon black that can be employed as a pigment component in the colorant in the present invention are furnace black, acetylene black, channel black, commercially available carbon black such as Printex G, Special Black 15, Special Black 4 and Special Black 4-B (made by Degussa Japan Co., Ltd), Mitsubishi #44, #30, MA-11 and MA-100 (made by Mitsubishi Carbon Co.), Raben 30, Raben 40 and Conductex SC (made by Columbia Carbon Co.), Regal 800, 400, 660 and Blackpearls L (made by Cabot Corp.).

Examples of organic pigments that can be employed as another pigment component in the colorant in the present invention are Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Permanent Red 4R, Brilliant First Scarlet, Hansa Yellow, Benzidine Yellow, Lake Red C, Lake Red D, Brilliant Carmine 6B, Permanent Red F5R, Pigment Scarlet 3B and Bordeaux 10B.

In the present invention, part of the olefin resins having a melt index of 25~700 g/10 min can be replaced by any of the following resins within the scope of the present invention: Natural-resin-modified phenolic resin, Natural-resin-modified maleic acid resin, dammar, copal, shellac, gum rosin, hardening rosin, ester-gum-glycerin-ester-modified maleic acid resin, styrene-butadiene copolymer, ethylene-vinyl acetate copolymer, polyolefins other than the polyolefins having a melt index of 25~700 g/10 min copolymers of the polyolefins having a melt index of 25~700 g/10 min, with the molecular weight thereof being 5000 or less and a melt index thereof being 1000 or more, and wax.

Specific examples of commercially available resins other than the olefin resins having a melt index of 25~700 g/10 min, including waxes, are as follows:

| Manufacturer | Trademark | Softening Point (°C.) |
|---|---|---|
| Union Carbide Corp. (U.S.A.) | DYNI | 102 |
| | DYNF | 102 |
| | DYNH | 102 |
| | DYNJ | 102 |

-continued

| Manufacturer | Trademark | Softening Point (°C.) |
|---|---|---|
| | DYNK | 102 |
| Monsanto Co. (U.S.A) | Orlizon 805 | 116 |
| | Orlizon 705 | 116 |
| | Orlizon 50 | 126 |
| Philips Petroleum Co. (U.S.A.) | Marlex 1005 | 92 |
| Du Pont de Nemours, E. I. & Co. | Alathon 3 | 103 |
| | Alathon 10 | 96 |
| | Alathon 12 | 84 |
| | Alathon 14 | 80 |
| | Alathon 16 | 95 |
| | Alathon 20 | 86 |
| | Alathon 22 | 84 |
| | Alathon 25 | 96 |
| Allied Chemical Corp. (U.S.A.) | AC Polyethylene 1702 | 85 |
| | AC Polyethylene 617, 617A | 102 |
| | AC Polyethylene 9, 9A | 117 |
| | AC Polyethylene 430 | 60 |
| | AC Polyethylene 405 | 96 |
| | AC Polyethylene 401 | 102 |
| | AC Polyethylene 540 | 108 |
| | AC Polyethylene 580 | 108 |
| Mitsubishi Rayon Co., Ltd. | BR-50 | 100 |
| | BR-80 | 105 |
| | BR-90 | 65 |
| | BR-95 | 80 |
| | BR-101 | 50 |
| | BR-102 | 20 |
| | BR-107 | 50 |
| Nihon Gas Chemical | Nikanol HP-70 | 70~90 |
| | Nikanol HP-100 | 105~125 |
| | Nikanol HP-120 | 125~145 |
| | Nikanol A-70 | 70~90 |
| | Nikanol A-100 | 110~130 |
| | Nikanol A-120 | 120~140 |
| Kodak Japan K.K. | Epolene N-14 | 105 |
| | Epolene E-15 | 96 |
| Sanyo Chemical Industries, Ltd. | Sanwax 131-P | 108 |
| | Sanwax 151-P | 107 |
| | Sanwax 161-P | 111 |
| | Sanwax 165-P | 107 |
| | Sanwax 171-P | 105 |
| | Sanwax E-200 | 95 |
| | Sanwax E-300 | 98 |
| | Viscol 330-P | 152 |
| | Viscol 550-P | 150 |
| | Viscol 660-P | 145 |
| | Viscol TS-200 | 145 |
| Quaker state Oil | QS-Wax | 65 |
| Junsei Chemical Co., Ltd. | Paraffin Wax | 60~90 |
| Hoechst A.G. (West Germany) | PED 521 | 104 |
| | PED 543 | 110 |

Of the resins other than the olefin resins having a melt index of 25~700 g/10 min, ethylene-vinyl acetate copolymer (vinyl acetate content: 1.0~50 wt%, preferably 10~40 wt%, softening point: 40°~180° C., preferably 60°~120° C.) is preferable for use. Typical examples of such an ethylene-vinyl acetate copolymer now on the market are as follows:

(1) Examples made by Du Pont - Mitsui Polychemicals Co., Ltd.

| Trademark | Vinyl Acetate Content (wt. %) | Softening Point (°C.) |
|---|---|---|
| Evaflex 45 | 46 | 94 |
| 40 | 41 | 98 |
| 150 | 33 | 120 |
| 210 | 28 | 85 |
| 220 | 28 | 90 |
| 250 | 28 | 135 |
| 260 | 28 | 155 |
| 310 | 25 | 90 |
| 360 | 25 | 185 |
| 410 | 19 | 90 |
| 420 | 19 | 100 |
| 450 | 19 | 135 |
| 560 | 14 | 170 |
| P-1403 | 14 | 70 |
| P-1207 | 12 | 70 |
| P-0607 | 6 | 72 |

(2) Examples made by TOSOH Corporation

| Trademark | Vinyl Acetate Content (wt. %) | Softening Point (°C.) |
|---|---|---|
| ULTRA-THENE 631 UE | 20 | 92 |
| 634 | 26 | 81 |
| 630 | 15 | 97 |

(3) Examples made by Allied Chemical Corp.

| Trademark | Vinyl Acetate Content (wt. %) | Softening Point (°C.) |
|---|---|---|
| 400 & 400A | 14 | 95 |
| 402 & 402A | 2 | 102 |
| 403 & 403A | 2 | 106 |
| 405 | 11 | 96 |
| 430 | 26 | 60 |

(4) Examples made by Hoechst Japan Limited

| Trademark | Vinyl Acetate Content (wt. %) | Softening Point (°C.) |
|---|---|---|
| TMREV720 | 25 | 102 |

(5) Examples made by BASF

| Trademark | Vinyl Acetate Content (wt %) | Softening Point (°C.) |
|---|---|---|
| SC9626 | 6~9 | 88~91 |

Humic acid, salts of humic acid and humic acid derivatives, which are collectively referred to as the humic acid component, will now be explained. The humic acid component is an alkali-soluble, amorphous, polymeric organic acid constituent of young coals with a low carbonizing degree, such as peat and lignite. The humic acid component is classified into a natural humic acid component and a synthetic humic acid component, both of which contain nitrohumic acid.

In the present invention, both the natural humic acid component and the synthetic humic acid component can be employed. There are three types of humic acid components for industrial use, that is, CH type, CHA type and CHN type, depending upon the molecular weight distribution, and each type has two sub-types, an acid-type, and a salt type (such as Na and $NH_4$ salts). All of these can be employed in the present invention.

The humic acid component is so well adsorbed by pigments that it is very advantageous to use the humic acid component for dispersing pigments finely to nearly primary particles, or for attaining good stability of the dispersion and accordingly for obtaining long shelf life of the developer.

The developer toner particles according to the present invention comprises a colorant in the form of the particles of a pigment which are overcoated with the olefin resin having a melt index of 25~700 g/10 min. This colorant may be prepared by a flushing method, with either a formulation (a) of a pigment and the olefin resin having a melt index of 25~700 g/10 min, or a formulation (b) of a pigment, the olefin resin having a melt index of 25~700 g/10 min, and a humic acid component.

More specifically, the above colorant is prepared as follows:

An aqueous dispersion of a pigment, free from the humic acid component, is added to a solution of the olefin resin having a melt index of 25~700 g/10 min dissolved in a solvent to form a mixed dispersion.

Alternatively, the humic acid component is added to the above-mentioned aqueous dispersion of a pigment in an amount of 0.1~30 wt.%. To this mixture, the above solution of the olefin resin is added to form a mixed dispersion.

Any of the above mixed dispersions is sufficiently kneaded in a kneader called "flusher", thus the water which covers each pigment particle is replaced by the resin solution. The water in the kneader is discarded, whereby a dispersion of the pigment particles dispersed in the resin solution is obtained.

This dispersion is dried and then the solvent is removed therefrom. As a result, a solid mass is obtained. The resulting solid mass is then crushed to powder, whereby a powder-like colorant is obtained.

This colorant consists of the pigment particles coated with the olefin resin having a melt index of 25~700 g/10 min, each particle being in the state of primary particle. This colorant is useful not only as a toner for electrophotography, but also as a colorant for use in printing inks and paints.

A liquid developer according to the present invention can be prepared by dispersing finely-divided colorant particles in a carrier liquid. As the carrier liquid, for instance, the following can be employed: petroleum-type aliphatic hydrocarbon with high electric insulating properties (for instance, with the electric resistivity thereof being $10^{10}$ Ωcm or more) and with a low dielectric constant (for instance, with the dielectric constant thereof being 3 or less), n-hexane, ligroin, such as n-heptane, n-pentane, isodecane, isooctane, and halogenated derivatives thereof, such as carbon tetrachloride and perchloroethylene.

As the commercial products of the petroleum-type aliphatic hydrocarbon that can be employed in the present invention, there are Isopar E, Isopar G, Isopar L, Isopar H, Isopar K, Naphtha No. 6 and Solvesso 100, which are produced by Exxon Chemical Co., Ltd. These can be used alone or in combination.

Conventionally a flushing method is known, in which, for instance, an aqueous dispersion of carbon black is kneaded together with a solution of a resin dissolved in a solvent, so that the water which covers the carbon black is replaced by the resin solution, and then a colorant is prepared by removing the water and the solvent. Even in this flushing method, since carbon black is not hydrophilic, it is not dispersed well in water and therefore cannot be dispersed therein in the form of finely-divided particles. Consequently, it is extremely difficult to disperse carbon black in the primary particle size. Therefore, in the case where a colorant, which is prepared by the conventional flushing method, without using the olefin resin having a melt index of 25~700 g/10 min, is used as toner particles in a liquid developer for electrophotography, images with high image density, excellent image gradation and image fixing performance, are difficult to form because of its poor dispersion in the carrier liquid.

Nevertheless, in order to improve the method of producing colorants by use of the flushing method, (i) a method of adding anionic, nonionic or cationic surfactants, or a polymer dispersing agent for synthesis of polymer, when a pigment such as carbon black is dispersed in water, and (ii) a method of dispersing a pigment such as carbon black by the use of the humic acid component, and kneading a low-molecular weight polyethylene, natural resin-modified resin, dammar, copal, shellac, gum rosin, styrene-butadiene copolymer, a low-molecular weight polyolefin and the like, and coating the pigment particles with the kneaded resin, which is disclosed in Japanese laid-open patent application No. 59-102253. However, the colorant prepared by the first method has the drawback that the dispersion of the colorant in the carrier liquid is insufficient, while the colorant prepard by the second method has the drawbacks that the colorant is poor in the compatibility and blending performance with other resins, accordingly the adhesiveness thereof is inferior to other colorants.

Preparation of colorants and examples of a developer according to the present invention will now be explained. These examples are given for illustration of the present invention and are not intended to be limiting thereof.

COLORANT PREPARATION EXAMPLE 1

A mixture of the following components was stirred well in a flusher:

| | |
|---|---|
| water | 500 g |
| carbon black (Printex G) | 150 g |
| humic acid | 10 g |

To the above mixture, 600 g of EVAFLEX A-701 and 500 g of toluene were added, and the mixture was kneaded. The kneaded mixture was then heated under reduced pressure to remove water and the solvent (toluene), whereby a lump of a colorant with a content of volatile components being 1.0% was obtained. The thus obtained colorant was ground in a stone mill, whereby finely-divided particles of the colorant having a particle size of 1~5 μm (hereinafter referred to Colorant No. 1) were obtained.

COLORANT PREPARATION EXAMPLES 2~5

Colorant Preparation Example 1 was repeated except that the formulation in Colorant Preparation Example 1 was replaced by the respective formulations in Table 1, whereby four different finely-divided colorants having a particle size of 1~5 μm (hereinafter respectively referred to as Colorants No. 2 to No. 5) were prepared.

COLORANT PREPARATION EXAMPLES 6 and 7

By merely mixing the respective components, without employing the flushing method, two different finely-divided colorants having a particle size of 1~5 μm (hereinafter respectively referred to as Colorants No. 6 and No. 7) were obtained.

TABLE 1

| Colorant Preparation Examples | Pigments | Olefin Resins (Melt Index 25~700) | Humic Acid Component | Other Components | |
|---|---|---|---|---|---|
| 2 | Regal 400 | N-410 | Nitrohumic acid | Epolene E14<br>Isopar H | 50 g<br>600 g |
| 3 | Tri-iron tetroxide | N-0903 | — | Benzoyl peroxide | 10 g |
| 4 | Mogal A | N-599 | — | BR-85<br>n-hexane | 50 g<br>500 g |
| 5 | Alkali Blue | (4) Ethylene - vinyl acetate - methacrylic acid copolymer resin | — | Divinyl benzene<br>Di-t-butyl peroxide | 50 g<br>15 g |
| 6 | MA-11 | (6) Propylene - vinyl acetate - acrylic acid copolymer resin | — | Br-102<br>Toluene | 50 g<br>600 g |
| 7 | Phthalocyanine Blue | (10) Ethylene - acrylic acid - trimethylol propane triacrylate copolymer resin | — | Isopar H | 600 g |

TABLE 2

| Colorant Preparation Examples | Pigments | Olefin Resins (Melt Index 25~700) | Humic Acid Component | Other Components |
|---|---|---|---|---|
| 8 | Alkali Blue | (3) Ethylene - vinyl acetate - ethyl acrylate - divinyl benzene copolymer resin | — | Toluene |
| 9 | Phthalocyamine Blue | (5) Propylene - vinyl acetate - lauryl methacrylate copolymer resin | — | — |
| 10 | Conductex SC | (6) Propylene - vinyl acetate - acrylic acid copolymer resin<br>Divinyl benzene 50 g<br>Di-t-butyl peroxide 10 g | Sodium salt of humic acid | n-hexane |
| 11 | Tri-iron tetroxide | (8) Ethylene - butyl acrylate - acrylic acid copolymer resin | Nitrohumic acid | — |
| 12 | Special Black | (10) Ethylene - acrylic acid - trimethylolpropane triacrylate copolymer resin | Nitrohumic acid | Isopar H |
| 13 | Raben 1250 | A-701 | Ammonium salt of humic acid | — |
| 14 | Mogal A | N-599 | Ammonium salt of humic acid | Isopar H |
| 15 | Regal 400 | N-410<br>Di-t-butyl peroxide 20 g | Ammonium salt of humic acid | Isopar H |

COLORANT PREPARATION EXAMPLES 8~15

Colorant Preparation Example 1 was repeated except that the formulation in Colorant Preparation Example 1 was replaced by the respective formulations in Table 2, whereby Colorants No. 8~No. 15 were prepared.

EXAMPLE 1

20 g of the finely-divided particles of the colorant prepared in Colorant Preparation Example 1 and 50 g of lauryl acrylate-acrylic acid copolymer resin (polymerization molar ratio 90:10) were added to 10 g of Isopar G. This mixture was kneaded in a ball mill for 72 hours, whereby a concentrate toner was prepared.

50 g of the thus prepared concentrate toner was dispersed in a 2 l of Isopar H, whereby a liquid developer No. 1 according to the present invention was prepared.

EXAMPLES 2 to 7

Example 1 was repeated except that the colorant employed in Example 1 was replaced by the respective colorants prepared in Colorant Preparation Examples 2 to 7, whereby liquid developers No. 2 to No. 7 according to the present invention were prepared.

By use of each of the above prepared liquid developers No. 1 through No. 7 in a commercially available electrophotographic copying machine (Trademark "Ricopy DT-1200" made by Ricoh Company, Ltd.), copies were made. The image density, resolution and image fixing performance obtained by each of the developers are shown in Table 3.

EXAMPLE 8

The lump of the colorant obtained in Colorant Preparation Example 1 was ground to finely-divided colorant particles having a particle size of 10 μm to 15 m, whereby a dry-type toner No. 8 according to the present invention was prepared.

EXAMPLES 9 to 14

Example 8 was repeated except that the colorant employed in Example 8 was replaced by the respective colorants prepared in Colorant Preparation Examples 2 to 7, whereby dry-type toners No. 9 to No. 14 having a particle size of 10 μm to 15 μm according to the present invention were prepared.

By use of each of the above prepared dry-type toners No. 8 to No. 14 in a commercially available electrophotographic copying machine (Trademark "Ricopy DT-1200" made by Ricoh Company, Ltd.), copies were made. The image density, resolution and image fixing performance obtained by each of the developers are shown in Table 3.

TABLE 3

| Examples | I.D. | Resolution | Image Fixing Performance (%) |
|---|---|---|---|
| 1 | 1.49 | 8.0 | 90 |
| 2 | 1.47 | 8.0 | 90 |
| 3 | 1.30 | 8.0 | 86 |
| 4 | 1.50 | 6.3 | 86 |
| 5 | 1.33 | 7.0 | 92 |
| 6 | 1.33 | 7.0 | 83 |
| 7 | 1.44 | 6.3 | 80 |
| 8 | 1.46 | 6.3 | 88 |
| 9 | 1.50 | 6.3 | 91 |
| 10 | 1.38 | 5.6 | 85 |
| 11 | 1.46 | 5.6 | 86 |
| 12 | 1.22 | 5.6 | 90 |
| 13 | 1.40 | 6.3 | 85 |
| 14 | 1.30 | 5.6 | 84 |

I.D.: Image Density

EXAMPLES 15 to 23

Examples 1 to 14 were repeated except that the finely-divided colorants employed in Examples 1 to 14 were respectively replaced by the finely-divided colorants prepared in Colorant Preparation Examples 8 to 15, whereby developers No. 15 to No. 23 were prepared.

The thus obtained developers were subjected to the same copy making test as that mentioned previously. Substantially the same results as in Examples 1 to 14 were obtained.

The dry-type toners and wet-type toners according to the present invention are capable of yielding high image density, high resolution and excellent image fixing performance. In particular, when carbon black is employed as the pigment, a significantly high image density can be obtained. It is considered that this is because carbon black is well dispersed in the olefin resin having a melt index of 25 to 700 g/10 min, or carbon black is well dispersed in the flushing colorants.

What is claimed is:

1. A developer for electrophotography comprising toner particles and a carrier, said toner particles comprising colorant particles coated with an olefin resin having a melt index of 25 to 700 g/10 min, measured under a load of 2160±10 g, at 190°±0.4° C.

2. The developer for electrophotography as claimed in claim 1, wherein said toner particles consist essentially of pigment particles coated with said olefin resins, which toner particles have been prepared by a flushing method.

3. The developer for electrophotography as claimed in claim 1, wherein said toner particles have been prepared by a flushing method and consist essentially of pigment particles, said olefin resin and a humic acid component selected from the group consisting of humic acid, a salt of humic acid, and a humic acid derivative.

4. The developer for electrophotography as claimed in claim 1, wherein said olefin resin is selected from the group consisting of:

(1) Ethylene-vinyl acetate-lauryl methacrylate copolymer resin (mole ratio 60:30:10), (2) Ethylene-vinyl acetate-methyl methacrylate-dimethylamino ethyl methacrylate copolymer resin (mole ratio 50:30:10:10), (3) Ethylene-vinyl acetate-ethyl acrylate-divinyl benzene copolymer resin (mole ratio 50:20:20:10), (4) Ethylene-vinyl acetate-methacrylic acid copolymer resin (mole ratio 50:40:10), (5) Propylene-vinyl acetate-lauryl methacrylate copolymer resin (mole ratio 60:30:10), (6) Propylene-vinyl acetate-acrylic acid copolymer resin (mole ratio 60:9:31), (7) Ethylene-ethyl acrylate copolymer resin (mole ratio 50:50), (8) Ethylene-butyl acrylate-acrylic acid copolymer resin (mole ratio 60:30:10), (9) Propylene-lauryl methacrylate-methacrylic acid copolymer resin (mole ratio 70:20:10),

(10) Ethylene-acrylic acid-trimethylolpropane triacrylate copolymer resin (mole ratio 80:15:5), and

(11) Propylene-ethyl laurate copolymer resin (mole ratio 50:50).

5. The developer for electrophotography as claimed in claim 2, wherein said pigment is selected from the group consisting of carbon black and organic pigments.

6. The developer for electrophotography as claimed in claim 1 in which said olefin resin is a copolymer comprised of a polyolefin main backbone chain having polar groups joined thereto and prepared by copolymerizing said polyolefin with a monomer having polar groups.

7. The developer for electrophotography as claimed in claim 1 in which said polyolefin resin has a bridge structure formed by a cross-linking agent or a radical initiator.

8. A developer for electrophotography as claimed in claim 2 in which said toner particles are free of an inorganic metal salt.

9. A developer for electrophotography as claimed in claim 3 in which said toner particles are free of an inorganic metal salt.

10. A developer for electrophotography as claimed in claim 2 in which said olefin resin is a terpolymer of (1) from 50 to 60 mole % of an olefin component selected from the group consisting of ethylene or propylene, (2) from 9 to 40 mole % of vinyl acetate and (3) from 10 to 31 mole % of acrylic acid, methacrylic acid or alkyl esters thereof.

11. A developer for electrophotography as claimed in claim 3 in which said olefin resin is a terpolymer of (1) from 50 to 60 mole % of an olefin component selected from the group consisting of ethylene or propylene, (2) from 9 to 40 mole % of vinyl acetate and (3) from 10 to 31 mole % of acrylic acid, methacrylic acid or alkyl esters thereof.

* * * * *